US006296363B2

(12) United States Patent
Chabot

(10) Patent No.: US 6,296,363 B2
(45) Date of Patent: Oct. 2, 2001

(54) MIRROR MOUNTING ASSEMBLY FOR HAIR GROOMING AND STYLING

(76) Inventor: J. Roland Chabot, 91 Westbury Ct., Thousand Oaks Ventura County, CA (US) 91360

( * ) Notice: Subject to any disclaimer, the term of this patent is extended or adjusted under 35 U.S.C. 154(b) by 0 days.

(21) Appl. No.: 09/739,049

(22) Filed: Dec. 15, 2000

Related U.S. Application Data

(62) Division of application No. 09/185,345, filed on Nov. 3, 1998.

(51) Int. Cl.[7] ..... G02B 7/182

(52) U.S. Cl. ..... 359/879; 359/880; 359/881; 359/871; 359/872

(58) Field of Search ..... 359/879, 880, 359/881, 871, 872; 248/475.1, 476, 479, 489, 495

(56) References Cited

U.S. PATENT DOCUMENTS 4,531,813 * 7/1985 Van den Berg ..... 359/879
4,895,337 * 1/1990 Oskam et al. ..... 248/487
5,745,310 * 4/1998 Mathieu ..... 359/843
5,865,415 * 2/1999 Hoernig ..... 248/486
6,120,155 * 9/2000 Brennan et al. ..... 359/857

* cited by examiner

*Primary Examiner*—Mohammad Sikder

(57) ABSTRACT

An improved mirror mounting assembly is designed for use with an existing mirror to enable viewing front, back, top and sides, of user's head during hair grooming and styling. The mirror assembly contains a mirror panel which is adjusable relative to existing mirror. The viewer sees two images: the normal frontal image of the back of viewer's head and shoulders. The mirror panel rotates to a protected position to prevent damage to panel and supporting structure when assembly is mounted on a door and door is opened against adjacent wall. Door mounting requires no tools. A modified support bracket permits securing assembly to a wall opposed to existing mirror. The mirror mounting assembly is convenient, protected, self-storing, safe and non-complex and enables user to readily view the front, back, top and sides of his or her head for hair grooming and styling.

6 Claims, 9 Drawing Sheets

MIRROR MOUNTING ASSEMBLY FOR HAIR GROOMING AND STYLING

This is a division of Ser. No. 9/185,345, filed Nov. 3, 1998.

BACKGROUND

1. Field of Invention

This invention relates to mirrors, specifically to an improved mounting of such mirrors when used to enable viewing front, back, top and sides of the user's head during hair grooming and styling.

2. Description of Prior Art

The need and desirability to readily view the back and top of one's head for hair grooming and for observing the back of one's clothing resulted in granting a number of U.S. patents for mirror viewing inventions for well over one hundred years. Many of the patents were granted because they enabled the user to view the back of his or her hair and clothing without the inefficiency and disadvantage of using a hand held mirror in combination with a fixed or movable mirror.

The structures and supports used to secure mirror panels and frames to furniture, ceilings, doors and walls were assemblies comprising of numerous and, in many cases, complex and expensive parts. Many were difficult to install because of their constructions and configurations. The shear size and bulk of many of these inventions would make their installations and use incompatible with many of today's bathrooms or dressing rooms. U.S. Pat. No. 4,269,382 to Coulson (1981) and U.S. Pat. No. 4,050,790 to Jorwa (1977), with mirror panels mounted to free-standing support structures, had the potential of becoming safety hazards due to their instability and their use in areas where persons moved about. Children and adults were exposed to potential risks of injy when using the mirrors or, when not in use, having the supporting structures fall on them.

Medicine cabinets with hinged, multiple mirror panels, as in U.S. Pat. No. 5,399,008 to Vann (1995) and U.S. Pat. No. 3,771,854 to Roark (1973), were self-storing but the mirrors limited the user's movements within the room while the mirrors were extended during viewing. Mirrors mounted on a door, as in U.S. Pat. No. 3,019,709 to Teason (1962), prevented the door from being closed and one of the mirrors was subject to damage if the door were opened against an adjacent wall.

Prior art inventions, such as U.S. Pat. No. 5,399,008 to Vann (1995), U.S. Pat. No. 5,223,984 to Schmid (1993) and U.S. Pat. No. 3,771,854 to Roark (1973), required one or more adjustments to orient or locate the mirror panel or panels to view the back and top of the user's head. After use, these inventions normally required the mirror panels to be returned to their closed or storage positions to facilitate personal movement within the room. The mirrors and support structures of U.S. Pat. No. 5,223,984 to Schmid (1993), U.S. Pat. No. 4,269,382 to Coulson (1981) and U.S. Pat. No. 4,050,790 to Jorwa (1977) were subject to damage by either opening or closing an adjacent door while they were in use, unless the mirror assemblies were very carefully located and installed within a room.

OBJECTS AND ADVANTAGES

Accordingly, several objects and advantages of this improved mirror mounting assembly are:

(a) to provide a mirror mounting assembly which enables the user to readily and efficiently view front, back, top and sides of his or her head;

(b) to provide a mirror assembly which does not require the user to pull down, fold out, adjust or move mirror or mirrors prior to and after use;

(c) to provide a mirror assembly which does not require relocation to a storage position after use to facilitate movement within the room;

(d) to provide a mirror assembly with a conveniently adjustable mirror panel;

(e) to provide a mirror assembly with a mirror panel which requires no adjustments prior to every viewing;

(f) to provide a mirror assembly not subject to damage due to inadvertent contact by the user, (g) to provide a mirror assembly which is not a safety hazard, particularly to small children and infants;

(h) to provide a mirror assembly not subject to damage when opening and closing the door on which the mirror assembly is mounted;

(i) to provide a mirror assembly, secured to a wall, which is not subject to damage when opening or closing an adjacent door;

(j) to provide a mirror assembly of such size, weight, construction and configuration which may be removably mounted onto a door without using any tools;

(k) to provide a mirror assembly which is easily removed from a door for cleaning or for installation in a different room or location, (l) to provide a mirror assembly easily secured to either a door or a wall;

Further objects and advantages are to provide a mirror mounting assembly which operates conveniently and effectively while consisting of relatively simple and inexpensive supporting and adjusting elements. Still further objects and advantages of my invention will become apparent from a consideration of the description and drawings.

DRAWING FIGURES

In the drawings, closely related figures have the same number but different alphabetic suffixes.

Figure 2A:
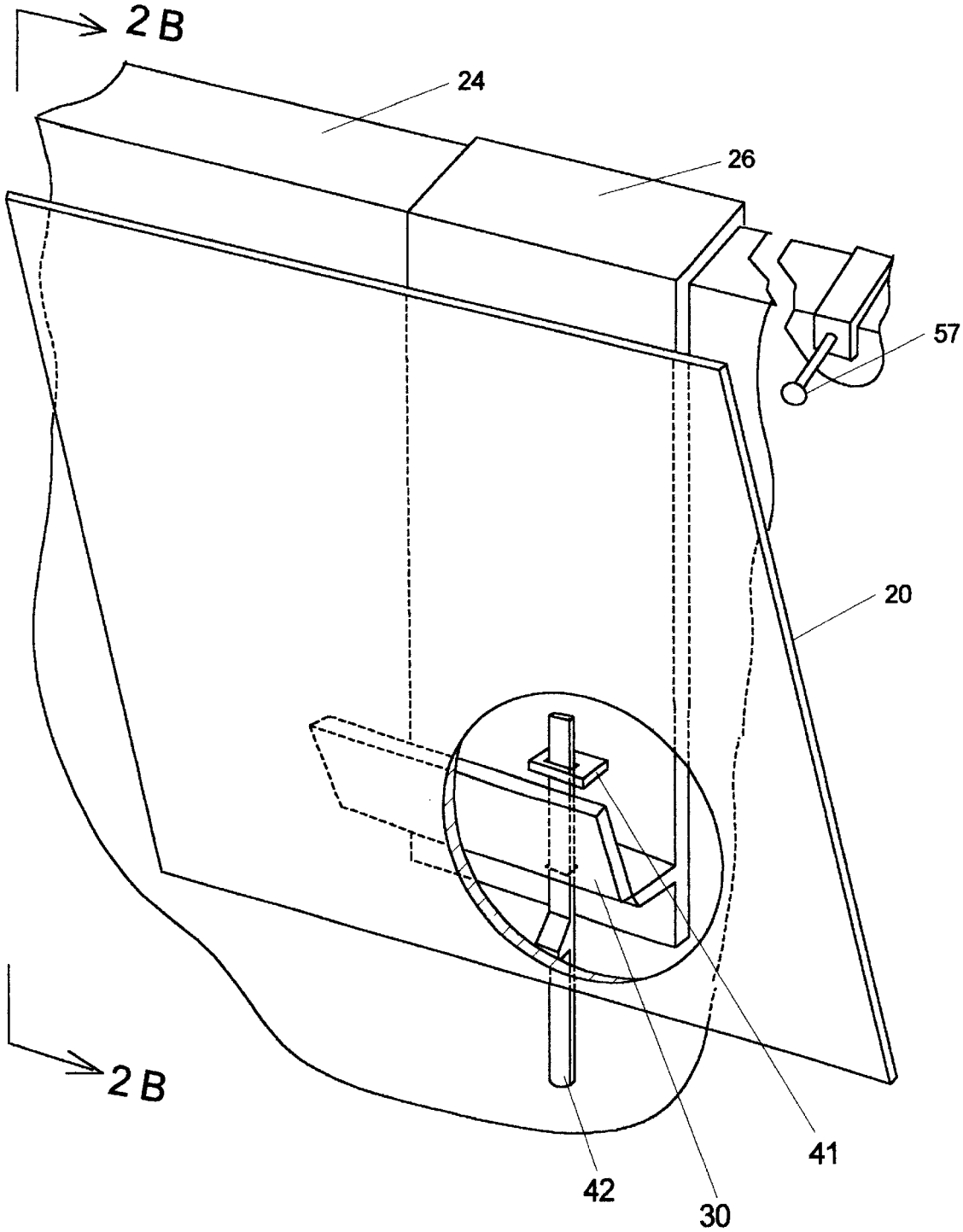

FIG. 2A perspective view of mirror assembly mounted on door, with mirror panel partially removed for clarity showing mounting, supporting and adjusting elements for mirror panel.

Figure 2B:
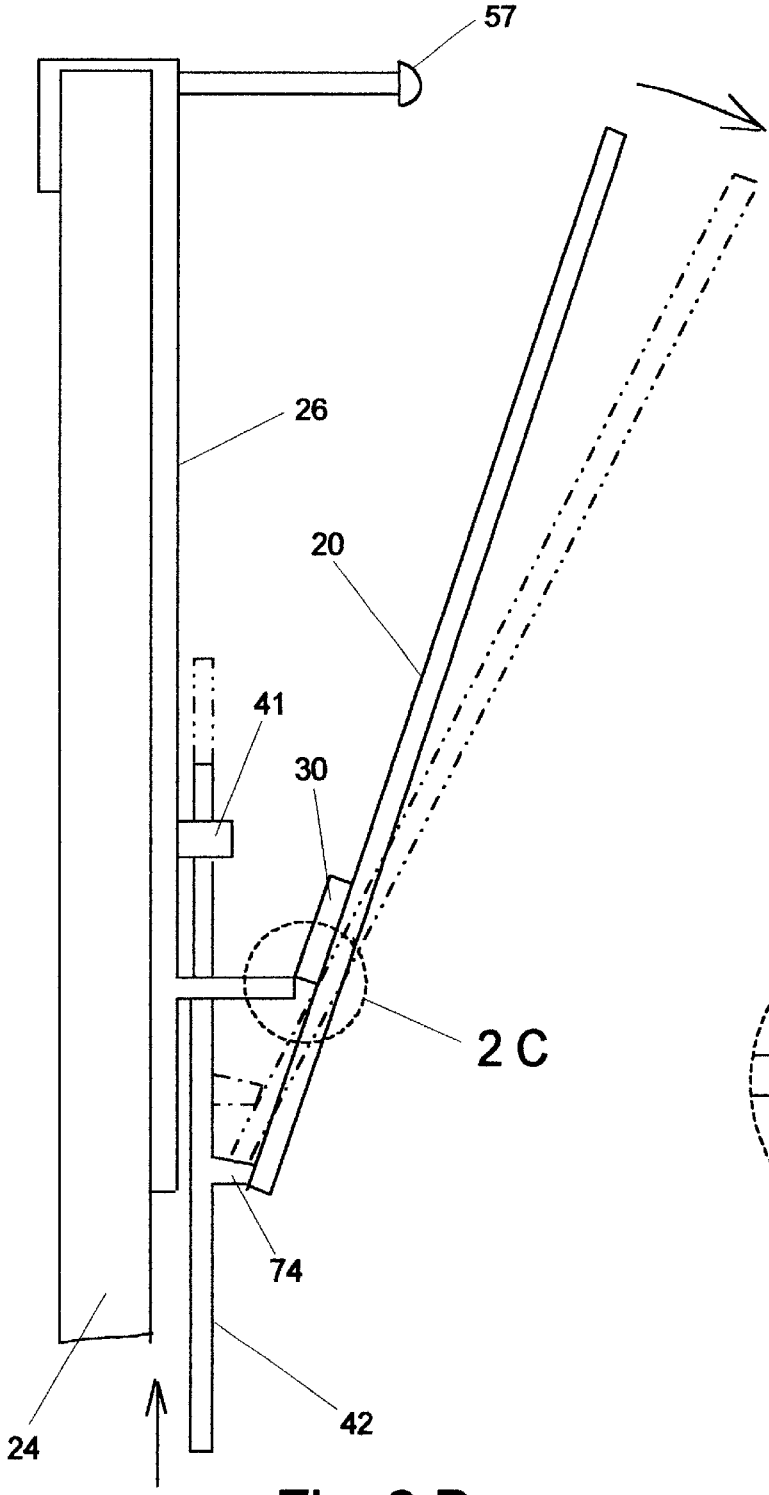

FIG. 2B is a side view with mirror panel in viewing position showing slidably mounted lever and boss, and showing alternate positions of slidably mounted lever and mirror panel.

Figure 2C:
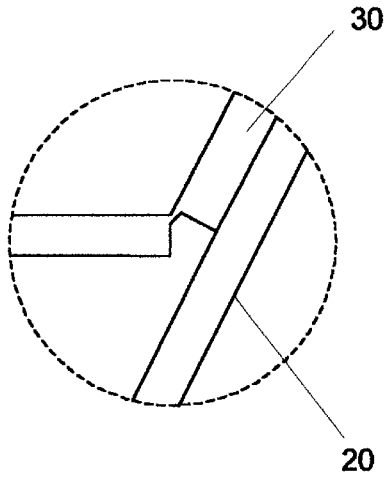

FIG. 2C is an enlarged view of hingable support attached to rear surface of mirror panel.

Figure 3A:
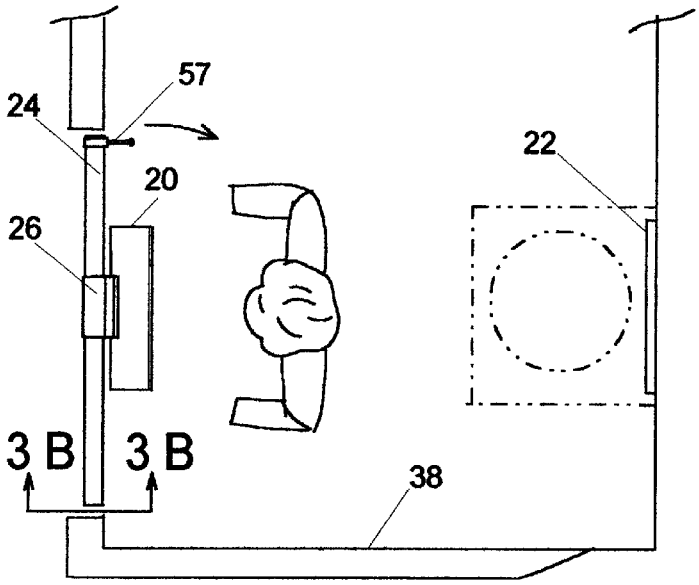

FIG. 3A is a top planview showing position of user viewing her images in mirror assembly mounted on door which, when closed, is opposed to existing mirror.

Figure 3B:
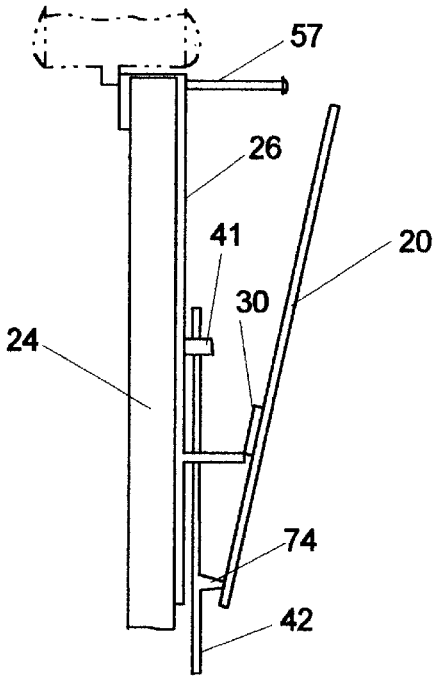

FIG. 3B is a side view, at an enlarged scale, showing mirror panel in viewing position when door is closed.

Figure 3C:
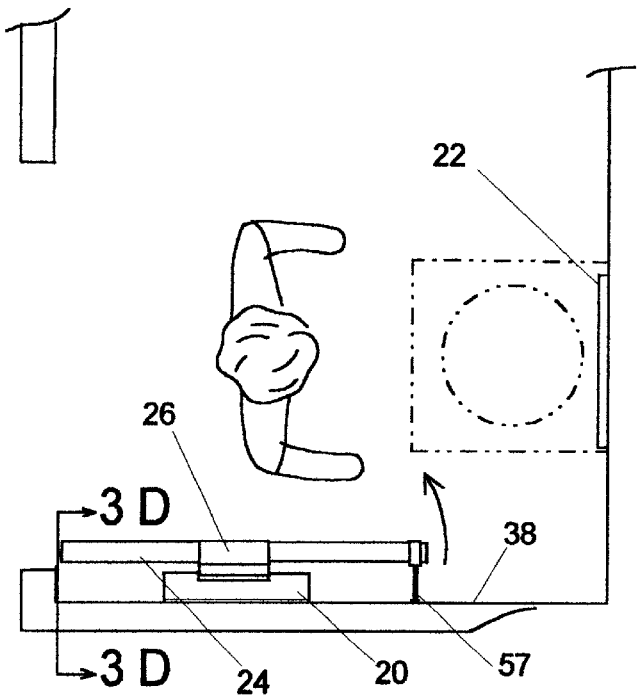

FIG. 3C is a top plan view showing mirror assembly with door open against adjacent wall.

Figure 3D:
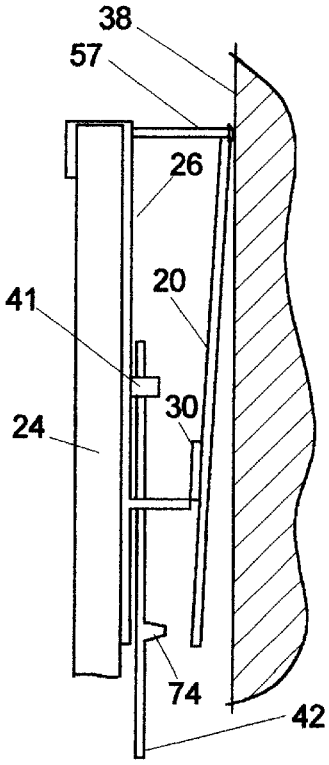

FIG. 3D is a side view, at an enlarged scale, showing mirror panel contacting adjacent wall and panel in its protected position when door is open against adjacent wall.

Figure 4A:
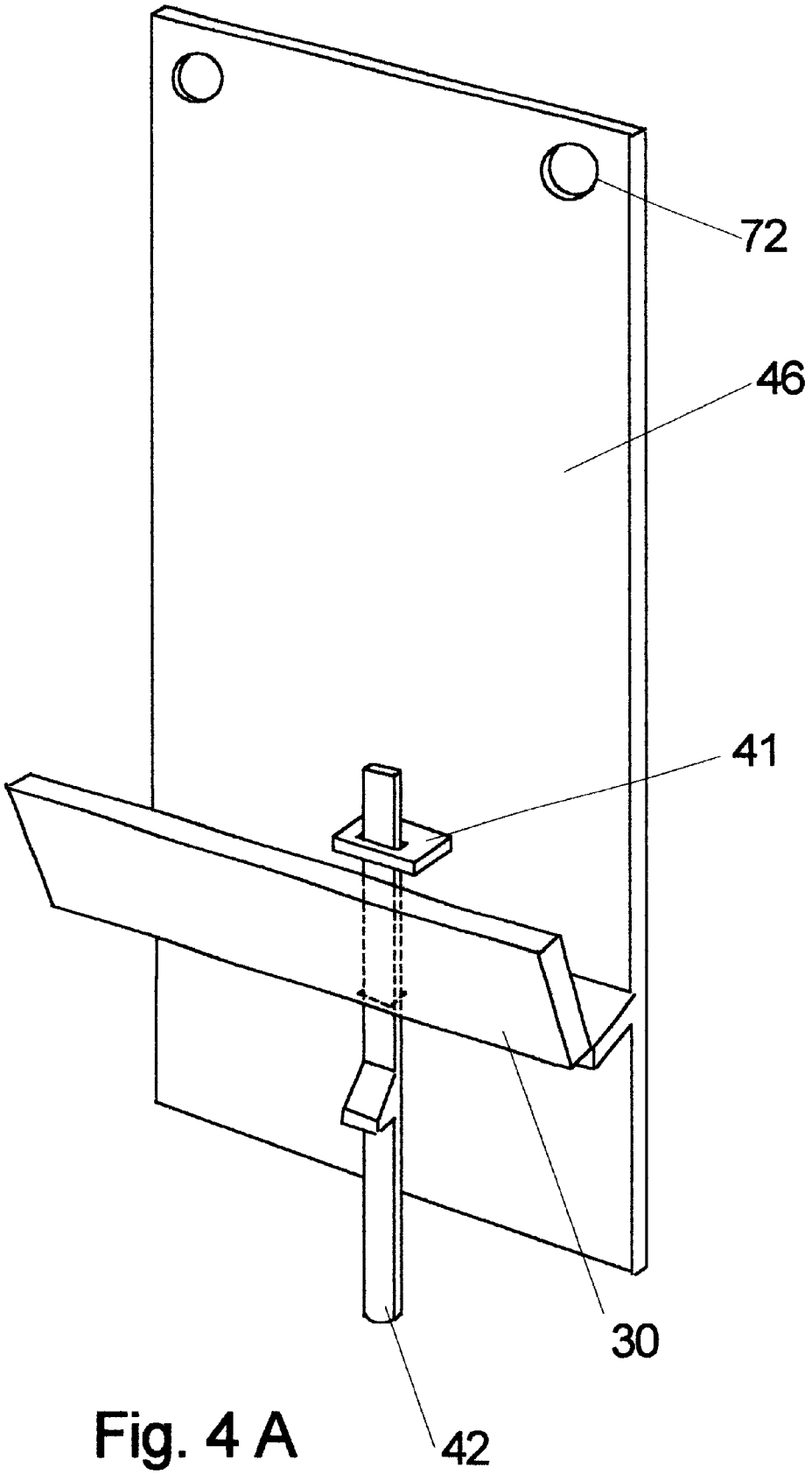

FIG. 4A is a perspective view, with mirror panel completely removed for clarity, showing support bracket used to secure to wall or door using screws.

Figure 4B:
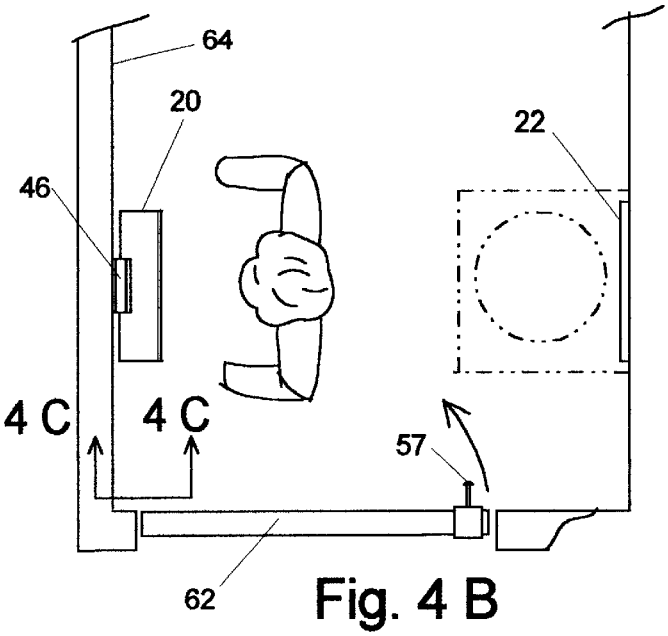

FIG. 4B is a top plan view showing position of user viewing her images in mirror assembly mounted to wall opposed to existing mirror.

Figure 4C:
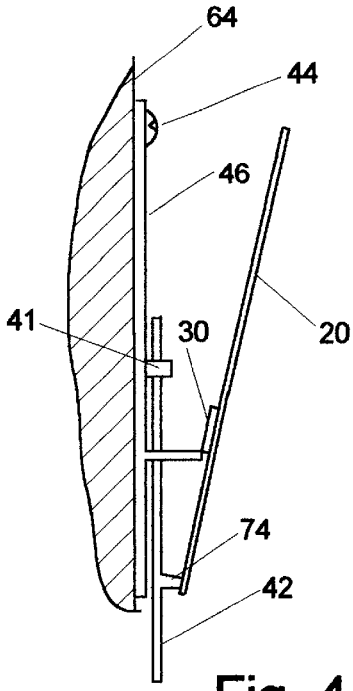

FIG. 4C is a side view, at an enlarged scale, showing mirror panel in viewing position.

Figure 4D:
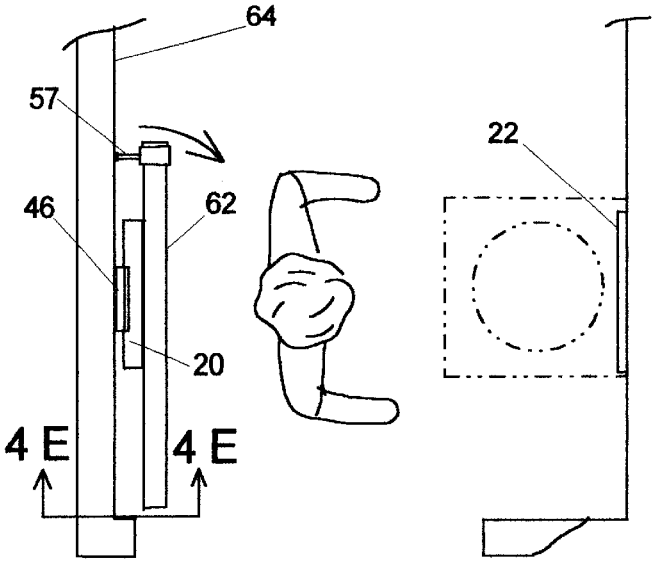

FIG. 4D is a top plan view showing door open against mirror assembly mounted on wall.

Figure 4E:
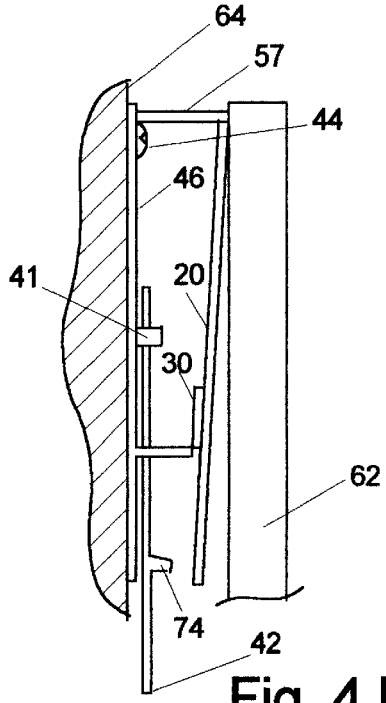

FIG. 4E is a side view, at an enlarged scale, showing mirror panel in its protected position when door is open against mirror assembly.

Figure 5A:
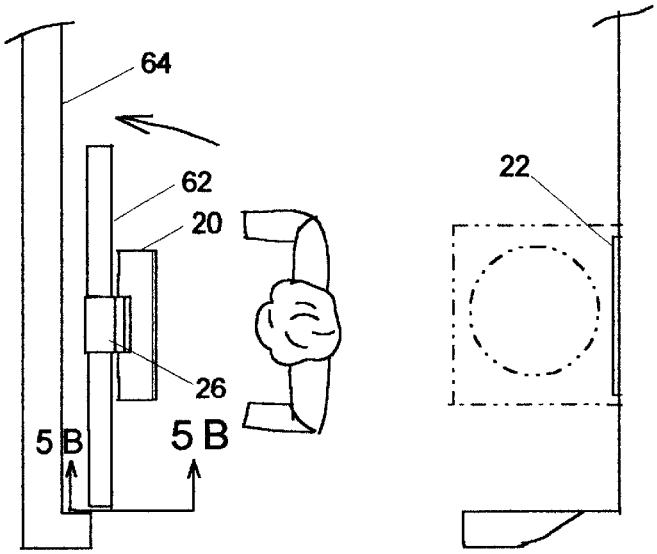

FIG. 5A is a top plan view showing position of user viewing her images in mirror assembly mounted on door which, when open into room, is opposed to editing mirror.

Figure 5B:
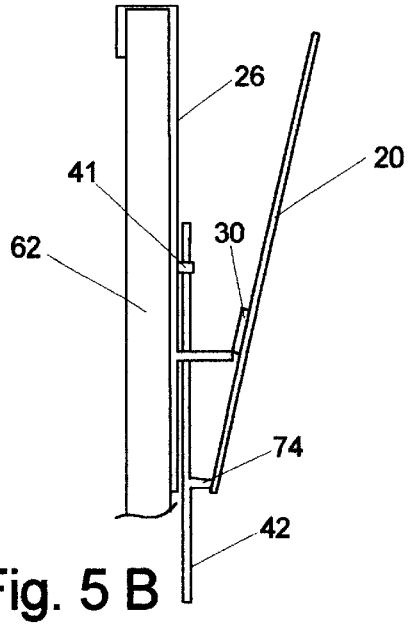

FIG. 5B is a side view, at an enlarged scale, showing mirror panel in viewing position.

Figure 5C:
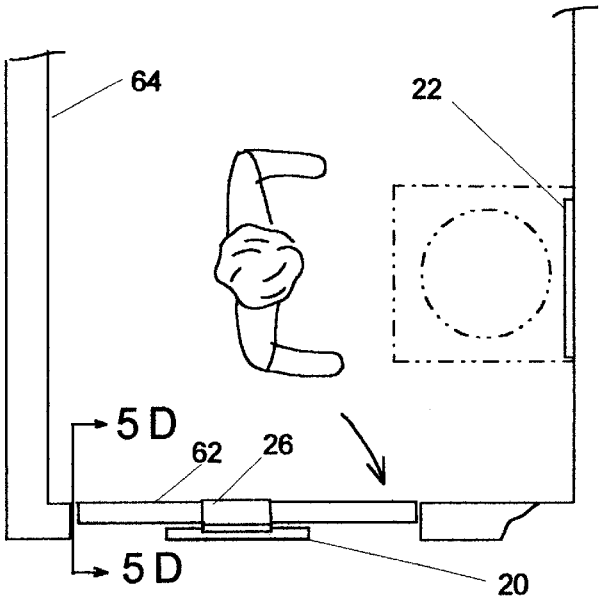

FIG. 5C is a plan view showing door in closed position.

Figure 5D:
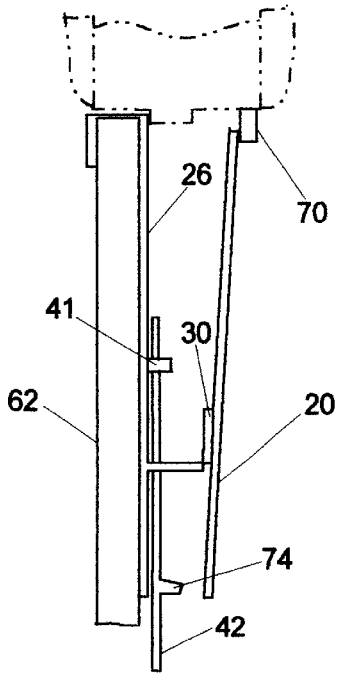

FIG. 5D is a side view, at an enlarged scale, showing mirror panel protected within door frame, when door is closed.

Figure 6A:
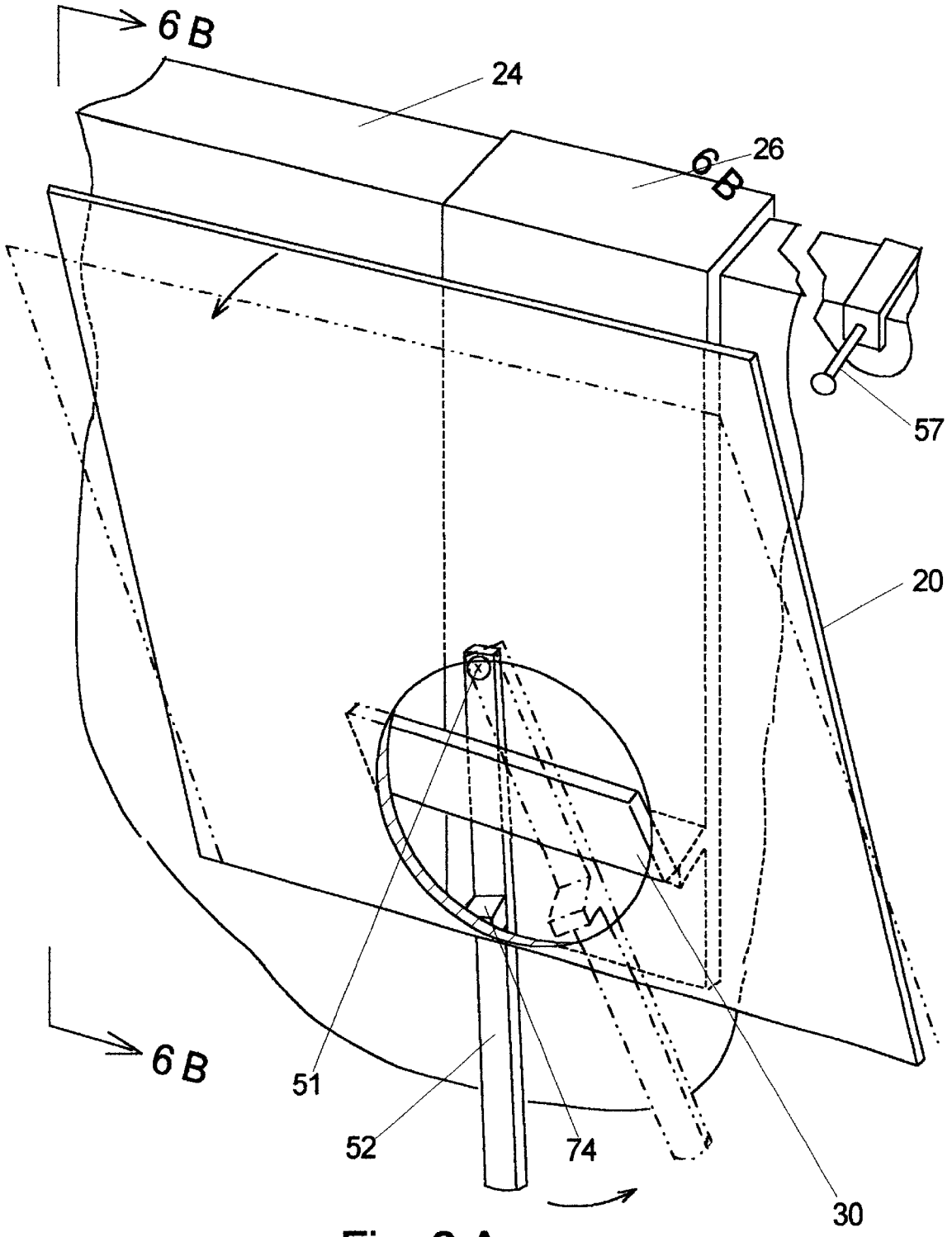

FIG. 6A is a perspective view of mirror assembly mounted on door, with mirror panel partially removed for clarity, showing mounting and supporting elements for mirror panel, and showing pivotably minted lever and boss for adjusting mirror panel.

Figures 6B, 6C:
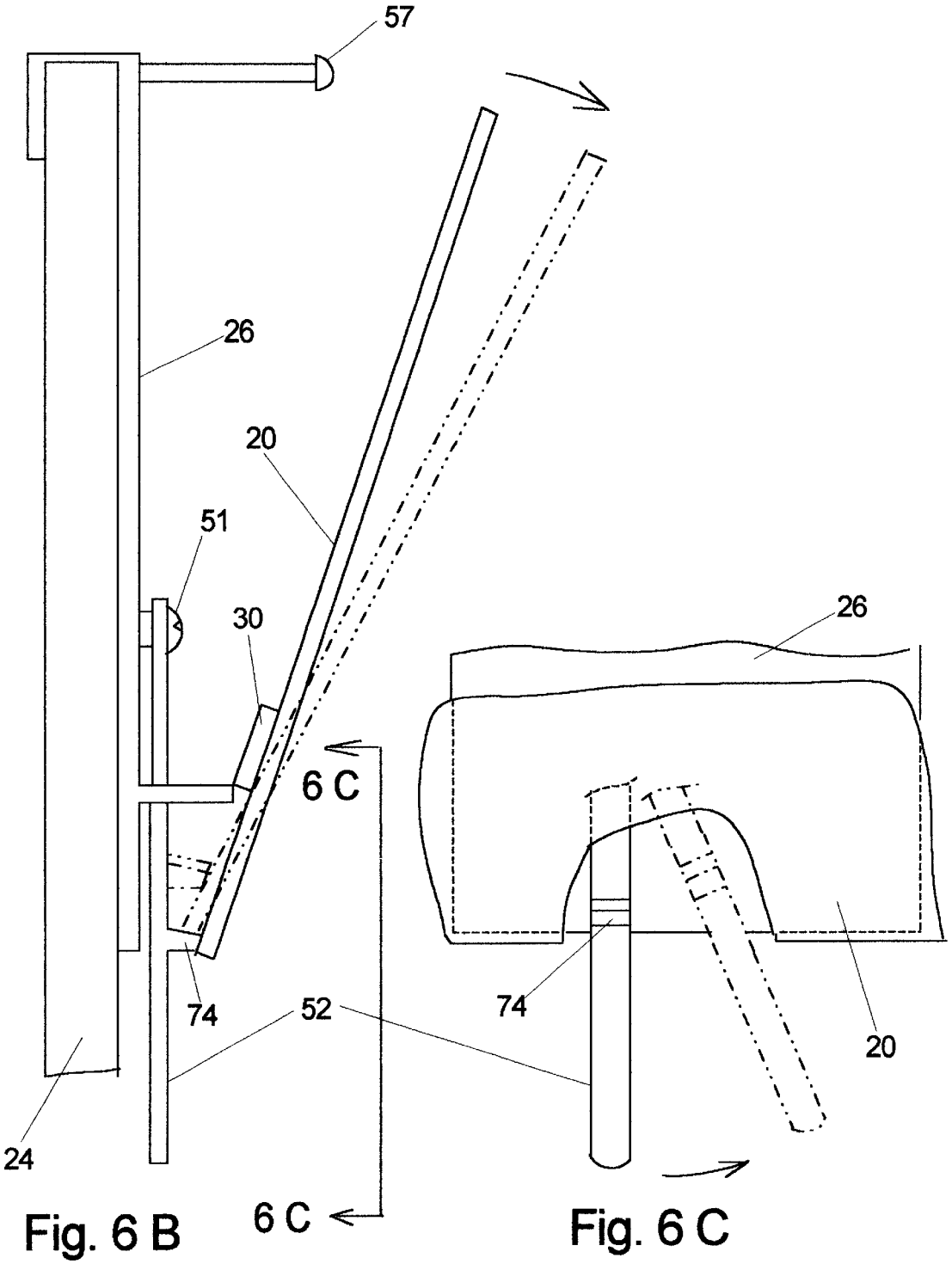

FIG. 6B is a side view who mirror panel in viewing position showing pivotably mounted lever and boss, and showing alternate positions of lever and mirror panel.

FIG. 6C is frontal partial view of motor assembly, with mirror panel partially removed, showing alternate position of pivotably mounted lever.

REFERENCE NUMERALS IN DRAWINGS

20 mirror panel
22 existing mirror
24 door
26 support bracket
30 hingable support
38 adjacent wall
41 lever guide
42 slidably mounted lever
44 screw
46 support bracket
51 lever pivot
52 pivotably mounted lever
57 door stop
62 door
64 opposed wall
70 mirror panel stop
72 mounting hole
74 boss

SUMMARY OF INVENTION

This mirror mounting assembly, mounted on a door or secured to a wall, and used in cooperation with an existing mirror, enables the user to readily view the front, back, top and sides of his or her head for hair styling and grooming. The initial setting of the desired viewing angle for the mirror panel is maintained after opening and closing the door to which the mirror assembly is mounted. Similarly, a one-time adjustment is required when the mirror assembly is secured to a wall and when opening and closing an adjacent door against the mirror panel. The mirror mounting assembly and its mirror panel are protected from damage for installations on a door or when secured to a wall. The mirror mounting assembly provides a convenient, protected, selfstong, safe and non-complex mirror panel for hair grooming and styling.

DESCRIPTION AND OPERATION OF INVENTION

Description—FIGS. 1A to 3D

Figure 1A:
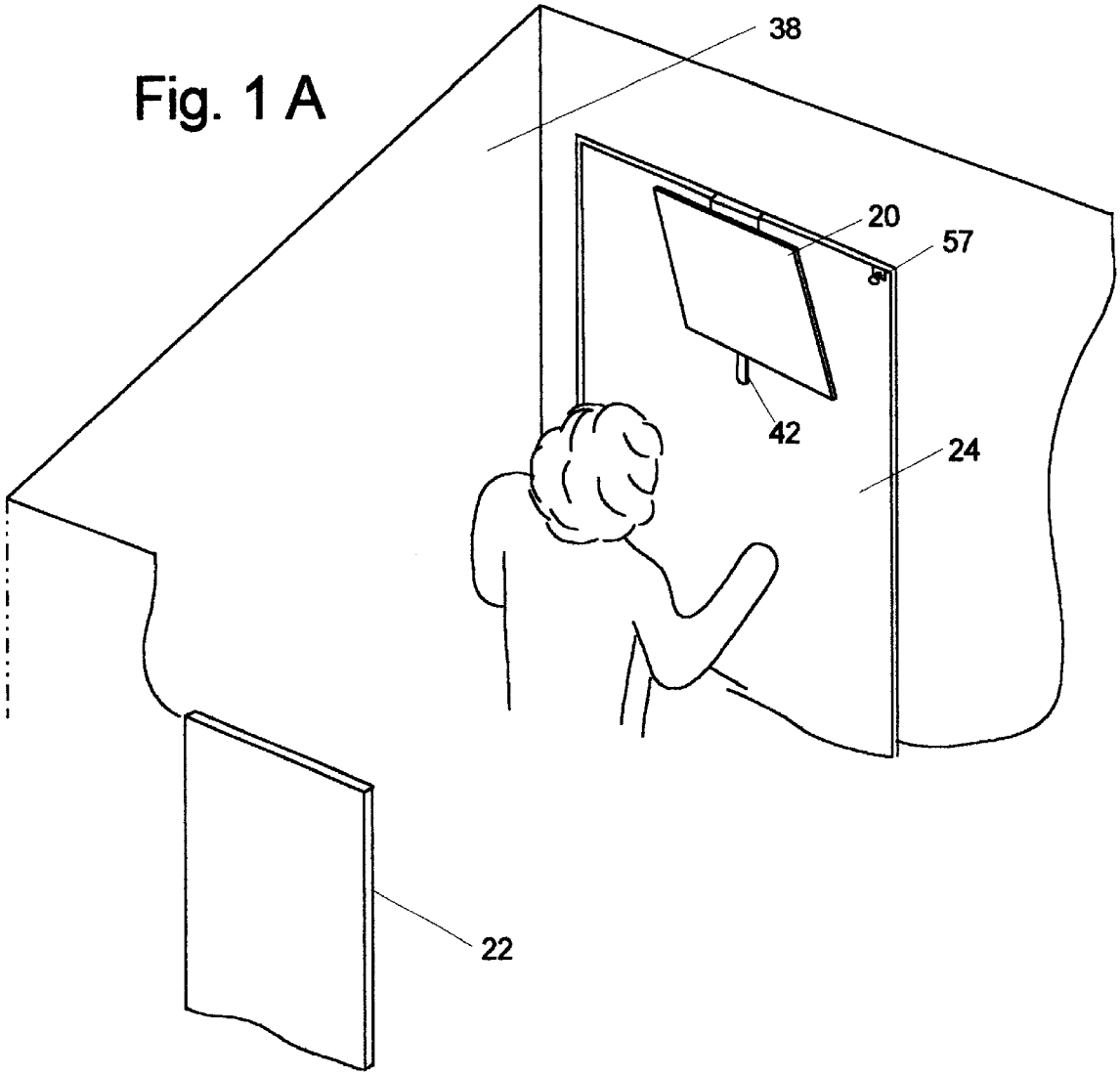
FIG. 1A is a perspective view showing mirror mounting assembly mounted on door and showing user position relative to present invention and to existing mirror.
Figure 1B:
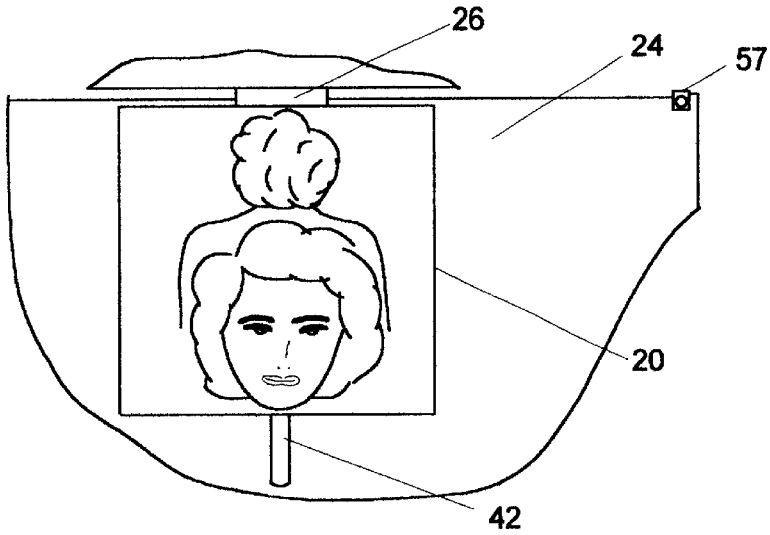
FIG. 1B is an enlarged view of mirror panel showing facial image and back image of user.

This embodiment of the mirror mounting assembly, mounted on the inside of a door 24, is shown in FIGS. 1A and 2A (perspective views). FIG. 1B illustrates the two images viewer sees in mirror panel 20. FIG. 2A and FIG. 2B (side view) show a support bracket 26 and a door stop 57 mounted on door 24 and show a hingable support 30 attached to bracket 26. FIGS. 2A and 2B illustrate attachment of a lever guide 41 to bracket 26, and lever guide 41 working in combination with slidably mounted lever 42. FIGS. 2A and 2B also illustrate location of boss 74 and its location and attachment to lever 42. FIG. 2C shows an enlarged view of hingable support 30 attached to rear surface of panel 20. FIG. 3A (top plan view) shows mirror assembly mounted on door 24, which opens in direction shown by arrow, and shows position of user relative to mirror mounting assembly and her position relative to an existing mirror 22. FIG. 3B (side view) illustrates mirror panel 20 in viewing position with its rear surface contacting boss 74. FIG. 3C (top plan view) illustrates mirror assembly mounted to door 24 which is open ast an adjacent wall 38. Mirror panel 20 is shown rotated to its protected, near-vertical position in FIG. 3D (side view).

Operation—FIGS. 1A to 3D

The user views front, back, top and sides of her head in mirror panel 20, adjusted to a desired viewing angle, by standing between mirror panel 20 and estuing mirror 22 as shown in FIGS. 1A and 3A. Two images appear in mirror panel 20 as illustrated in FIG. 1B, a facial image and an image of the back of the head and portions of the user's back. Support bracket 26 is constructed to permit installing mirror assembly on door 24 as shown in FIG. 2A without using tools. The shape of top portion of bracket 26 permits engagement over top edge of door 24 to support mirror assembly. Similarly, door stop 57 slips onto door 24 without using tools. Hingable support 30 permits mirror panel 20 to rotate freely about bracket 26 until rear surface of panel 20 makes contact with boss 74 as illustrated in FIG. 2B. Viewing angle of mirror panel 20 is adjusted by moving slidably mounted lever 42 along vertical axis through lever guide 41. When lever 42 and boss 74 are moved upwardly, as indicated by arrow to alternate position illustrated in FIG. 2B, panel 20 rotates freely from its own weight until rear surface of panel 20 contacts boss 74, and the alternate position panel 20 shown in FIG. 2B illustrates the changed viewing angle. Sliding lever 42 and boss 74 downwardly applies a force to rear surface of panel thereby urging panel to a new viewing angle.

FIGS. 3C and 3D illustrate how mirror panel 20 is protected from damage when door 24, which provides access into room, is opened against adjacent wall 38. When door 24 is opened and approaches adjacent wall 38, front source of mirror panel 20 makes initial contact with wall 38. Once contact is made, further opening door 24 results in a force from wall 38 urging top portion of mirror panel 20 to rotate until it reaches its near-vertical, protected position, illustrated in FIG. 3D. Door stop 57 maintains a predetermined distance between door 24 and adjacent wall 38, thus preventing damage to mirror panel 20 and mirror mounting assembly, as illustrated in FIG. 3D. As door 24 closes and moves away from adjacent wall 38, mirror panel 20 freely rotates to its preset viewing angle when rear surface of panel 20 contacts boss 74, as shown in FIG. 3B.

Viewing reflections in mirror panel 20, the user is able to observe two images as shown in FIG. 1B. The first image is of the front of the viewer's face and hair. The second image is of back and top of the viewer's head. Side views are observed by slight side-to-side rotation of user's head. In combination, these images enable user to readily observe front, back, top and sides of his or her head during hair grooming and styling.

Alternatively, user may face existing mirror 22, and observe frontal image normally seen in mirror 22, and concurrently view image of back and top of his or head from mirror panel 20 reflected to existing mirror 22.

Description—FIGS. 4A to 4E

FIG. 4A (perspective view with mirror panel 20 removed) illustrates a support bracket 46 used for a more permanent mounting of the mirror assembly. Bracket 46 may be used to secure mirror assembly to a wall or to a door. In this description, bracket 46 secures mirror assembly to a wall 64 when wall 64 is opposed to existing mirror 22 as shown in FIG. 4B (top plan view). Bracket 46 includes a mounting hole 72 for securing to wall 64 using a screw 44, as shown in FIG. 4C (side view). Hingable support 30 and lever guide 41 are joined to bracket 46. Mirror panel 20, slidably mounted lever 42, lever guide 41, boss 74 and door stop 57 are identical to those used in previously described embodiments. FIG. 4B shows mirror assembly mounted on wall 64 and shows position of user relative to mirror assembly and relative to existing mirror 22. FIG. 4C shows mirror panel 20 in viewing position. FIG. 4D (top plan view) shows door 62 open against wall 64. FIG. 4E (side view) illustrates mirror panel 20 in its protected, near-vertical position when door 62 is closed against wall 64.

Operation—FIGS. 4A to 4E

FIG. 4A illustrates support bracket 46 secured to wall 64 using screw 44. When door 62 is opened in direction of arrow shown in FIG. 4B, to provide access into room, door 62 makes initial contact with front surface of panel 20. Once contact is made, further opening door 62 provides a force urging panel 20 to rotate until it reaches its near-vertical, protected position, illustrated in FIG. 4E. As door 62 moves away from wall 64, mirror panel 20 rotates from its own weight to its preset viewing angle, determined by position of slidably mounted lever 42 and boss 74. Operation of this embodiment is seen to be nearly identical to the embodiment of FIGS. 2A and 3A, except that support bracket 46 is used to attach to a wall, whereas support bracket 26 is used to mount on a door in embodiment illustrated in FIGS. 2A and 3k Description—FIGS. 5A to 5D This embodiment may use any one the mirror assemblies described in FIG. 2A, FIG. 4A or FIG. 6A. FIGS. 5A to 5D illustrate the use of the mirror assembly illustrated in FIG. 2A. Door stop 57 is not required since distance between door 62 and wall 64 does not need to be controlled for this embodiment. Installation of mirror assembly for this embodiment is on outside of door 62, as shown in FIGS. 5A and 5C (top plan views). FIG. 5A illustrates position of user relative to mirror assembly and relative to existing mirror 22 when door 62 is open. FIG. 5B shows panel 20 in viewing position when door 62 is open. FIG. 5C (top plan view) shows door 62 in closed position. A mirror panel stop 70, attached to a door frame, is shown in contact with top portion of panel 20 in FIG. 5D (side view).

Operation—FIGS. 5A to 5D

Operation of this embodiment, illustrated in FIGS. 5A to 5D, is nearly identical to operation and viewing angle adjustment of the embodiment described in FIGS. 1A to 3D. FIG. A illustrates mirror assembly in viewing position with door open. mirror panel 20 is at preset viewing angle with panel 20 in contact with boss 74 as shown in FIG. 5B. This embodiment includes mirror panel stop 70 which acts to prevent panel 20 from protruding beyond door frame when door is in closed position, illustrated in FIG. 5D. As door 62 is moved into door frame (direction of arrow in FIG. 5C), panel 20 contacts stop 70, thus forcing panel 20 to rotate from preset viewing angle to protected position shown in FIG. 5D. The protection of panel 20, provided by the door frame, effectively minimizes the probability of damage to the mirror assembly by preventing contact with panel 20 when someone is waln near the outside of closed door 62.

Description—FIGS. 6A to 6C

This embodiment of the mirror mounting assembly, mounted on door 24, is shown in FIG. 6A (perspective view). (FIG. 1B illustrates the two images viewer sees in a mirror panel 20.) FIG. 6A and FIG. 6B (side view) show a support bracket 26 and a door stop 57 mounted on door 24 and show a hingable support 30 attached to bracket 26 and to rear surface of panel 20. FIGS. 6A to 6C illustrate attachment of a lever pivot 51 to bracket 26, and also illustrate a boss 74 and its location on and attachment to lever 52. Alternate positions of lever 52 and boss 74 are shown in FIGS. 6A to 6C and illustrate alternate position of mirror panel 20. These figures also show the rear surface of mirror panel contacting boss 74.

Operation—FIGS. 6A to 6C

The operation of this embodiment is very similar to the operation described in FIGS. 1A to 3D, the primary difference being the use of a pivotably mounted lever 52 used with boss 74 in this embodiment rather than a slidably mounted lever 42 used with boss 74 in the previous embodiment. An additional physical difference is the use of lever guide 41 versus lever pivot 51.

The viewing angle of mirror panel 20 is adjusted by rotating pivotably mounted lever 52. When lever 52 is rotated about lever pivot 51, as shown by arrow in FIG. 6A, and boss 74 is moved upwardly to alternate position, panel 20 rotates freely from its own weight until rear surface of panel 20 contacts boss 74. FIG. 6B illustrates rotation of lever 52 and upward movement of boss 74 permitting mirror panel 20 to move to alternate position shown by arrow. Movement of panel to alternate position occurs because upward movement of boss 74 results in a gap between boss 74 in its rotated position and rear surface of mirror panel. The alternate position of panel 20 shown by arrow in FIGS. 6A and 6B illustrates the changed viewing angle resulting from rotating lever 52. Rotating lever 52 and boss 74 downwardly applies a force from boss 74 to rear surface of mirror panel 20 thereby urging panel 20 to a new viewing angle.

Operation of this embodiment provides the same damage protection for mirror panel 20 and the mirror assembly. The mirror assembly using this embodiment, protects the mirror panel and maintains the desired viewing angle when installed on a door or secured to a wall, similar to the installations illustrated in FIG. 1A, FIGS. 3A to 3D, FIGS. 4B to 4E, and FIGS. 5A to 5D.

Summary, Ramifications, and Scope

Accordingly, the reader will see that the mirror mounting assembly is an effective, convenient, protected, self-storing, safe and non-complex device which enables the user to readily view the front, back, top and sides of his or her head for hair grooming and styling. Furthermore, the mirror mounting assembly has the following additional advantages:

- it provides features for preventing damage to the mirror panel when mounted on a door or when secured to a wall;
- it provides a convenient method of setting and maintaining the desired viewing angle of mirror panel for initial installation and, when necessary, to readily adjust the viewing angle for users of widely varying heights;
- it readily mounts on top edge of a door without using tools and is easily removed from door for cleaning or for installation in a different room or location;

While my above description contains many specificities, these should not be construed as limitations on the scope of the invention, but rather as an exemplification of the preferred and alternate embodiments thereof Many other variations are possible. For example, the adjusting lever may have other configurations, the mirror panel may have other shapes such as round, oval, etc.; the mirror panel may be framed or not framed, may be standard glass, plastic or polished metal; materials for various elements may be plastic, metal or a combination of the two; the hingable support may include a hinge made of plastic, of metal or of a combination thereof, other methods of securing the mirror assembly to a door or wall may be used, such as adhesives, nails, anchoring bolts, etc.; the mirror panel stop is shown as a block of material attached to the door frame but it may be a threaded member screwed into door frame; the door stop illustrated slips over top of door but a standard permanent door stop may be used; the support bracket may be one piece or modular construction; portions of the rear surface of the mirror panel in contact with the boss and the boss itself may incorporate surfaces with low function characteristics; the boss may incorporate a wheel or other feature to minimize the forces required to rotate or slide the levers.

Accordingly, the scope of the invention should be determined not by the embodiments illustrated, but by the claims and their legal equivalents.

I claim:

1. A mirror mounting assembly for hair grooming and styling, used cooperatively with an existing mirror, said existing mirror having an opposed mounting surface for securing the mirror assembly, comprising:

(a) a mirror panel having a front reflecting surface and a rear surface, (b) a hingable support with means for attaching to said rear surface and to a support bracket, (c) said support bracket having mounting means for securing the mirror assembly to said opposed mounting surface, (d) means for adjusting a desired viewing angle comprising a lever secured to said support bracket, said lever including a boss, said hingable support permitting the panel to rotate to a near-vertical position when a force is applied to top portion of said front reflecting surface and permitting the panel to rotate freely until said rear surface of the panel makes contact with said boss and returns to said desired viewing angle when said force is removed, wherein said boss contacting said rear surface adjustably sets and maintains the panel to the viewing angle, said lever and said boss acting cooperatively to force said rear surface either inwardly or outwardly relative to said mounting surface, said boss permitting the panel to rotate inwardly when vertical position of said boss is changed upwardly, and urging the panel to rotate outwardly when vertical position of said boss is changed downwardly, wherein the user readily views front, back, top, and sides of his or her hair in said mirror panel for hair grooming and styling.

2. The mirror mounting assembly of claim 1 wherein said support bracket includes attaching means for removably mounting the mirror assembly, without requiring tools, over top edge of a door when said door is opposed by said existing mirror.

3. The mirror mounting assembly of claim 1 wherein said lever is a slidably mounted lever and a lever guide limits the lever to movement in vertical direction only.

4. The mirror mounting assembly of claim 3 wherein said support bracket includes attaching means for removably mounting the mirror assembly, without requiring tools, over top edge of a door when said door is opposed by said existing mirror.

5. The mirror mounting assembly of claim 1 wherein said lever is a pivotably mounted lever and a lever pivot limits the lever to rotational movement only.

6. The mirror mounting assembly of claim 5 wherein said support bracket includes attaching means for removably mounting the nnfor assembly, without requiring tools, over top edge of a door when said door is opposed by said existing mirror.

* * * * *